US006546196B1

(12) United States Patent
Wu

(10) Patent No.: US 6,546,196 B1
(45) Date of Patent: Apr. 8, 2003

(54) VERTICALLY WORKING LIQUID VAPORIZER

(76) Inventor: Chia-Hsiung Wu, P.O. Box No. 6-57, Chung-Ho, Taipei 235 (TW)

( * ) Notice: Subject to any disclaimer, the term of this patent is extended or adjusted under 35 U.S.C. 154(b) by 0 days.

(21) Appl. No.: 09/986,488

(22) Filed: Nov. 9, 2001

(51) Int. Cl.[7] ..... F24F 6/00
(52) U.S. Cl. ..... 392/394
(58) Field of Search ..... 392/386, 390, 392/391, 392, 393, 394, 403, 404, 405, 408; 219/534, 544, 546, 547, 548

(56) References Cited

U.S. PATENT DOCUMENTS 4,104,509 A * 8/1978 Van Bokestal et al. .... 174/52.2
4,223,208 A * 9/1980 Kleinschmidt et al. ..... 219/530
4,395,623 A * 7/1983 Shimada et al. ..... 219/505
4,700,050 A * 10/1987 Hennuy et al. ..... 219/385
4,903,850 A * 2/1990 Frank et al. ..... 392/403
5,598,502 A * 1/1997 Takahashi et al. ..... 219/505

* cited by examiner

*Primary Examiner*—Sang Paik
(74) *Attorney, Agent, or Firm*—Troxell Law Office PLLC

(57) ABSTRACT

A vertically working liquid vaporizer, more especially a vaporizer providing liquid vaporization and to be heated longitudinally to make the topmost liquid easy to be vaporized immediately, has a cup body with a hollow standing post axially disposed at the center and a ceramic-made electric resistance of a positive temperature coefficient pivotally disposed inside; thereby a vertically working liquid vaporizer is formed by the heat generated from the said generator and transmitted through the standing post to achieve the primary objective of fast vaporizing the bordering point of the liquid surface vertically from the top to the bottom.

3 Claims, 4 Drawing Sheets

VERTICALLY WORKING LIQUID VAPORIZER

BACKGROUND OF THE INVENTION

1) Field of the Invention

The present invention relates to a vertically working liquid vaporizer, more especially to a vaporizer capable of vertically heating the liquid from the top to the bottom to make the liquid fast generate vaporizing effect.

2) Description of the Prior Art

Accordingly, for the common liquid vaporizer, basically the bottom portion of a water boiler is heated to heat the entire liquid housed inside; when the entire liquid body reaches the critical point for vaporization, it vaporizes in the form of steam; as to the facial steamer for cleansing the skin, it usually has a cup body for housing the water liquid and the bottom portion thereof is affixed with a heater in any kind of form for heating the entire housed liquid until it vaporizes after reaching the critical point for vaporization; however, the waiting time prior to working is longer.

SUMMARY OF THE INVENTION

Therefore, the present invention particularly provides a vertically working liquid vaporizer by film-line heating the bordering line between the upper surface film of the liquid and the circumference of the outer circular surface of the standing post in various structures to achieve the objective of immediately, partially heating the liquid, fast and stably generating the vaporizing effect.

Another objective of the present invention is to adapt to various needs by disposing a dripping device at the position relative to the upper aspect of the said vaporizer; micro supplement by dripping eliminates extending the preparing job of elevating the temperature of the water liquid and thereby achieves the efficacy of immediate vaporization and dispensation.

Yet another objective of the present invention is that the heat generator adapted by the said vaporizer can be a ceramic-made electric resistance tab body of positive temperature coefficient; by using the efficacy of its rapid temperature elevation and automatically controlling the on/off of the electric current, the temperature can be fast elevated to eliminate extra cost for the temperature control equipment and to achieve multiple safe feasibilities of obtaining precise and constant temperature.

To enable a further understanding of the structural features and the technical contents, the brief description of the drawings below is followed by the detailed description of the preferred embodiment.

DETAILED DESCRIPTION OF THE PREFERRED EMBODIMENTS

Figure 1:
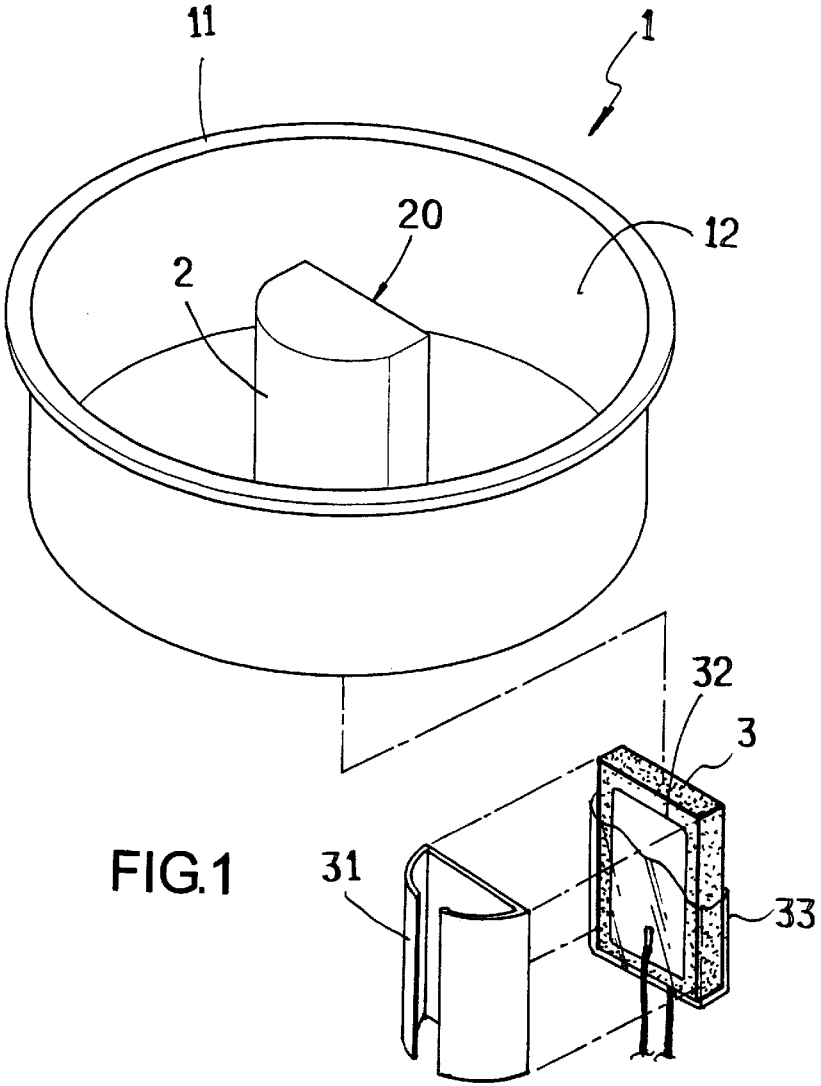
FIG. 1 is a pictorial drawing of the relationship among the elements of the present invention.

The present invention of a vertically working liquid vaporizer, referring to FIG. 1, mainly comprises a cup body (1) with a standing post (2) disposed at the center thereof and an encircling dam (11) situates in between to define a receiving container (12); a heat generator (3) of a ceramic-made electric resistance of positive temperature coefficient is mounted downwardly from the said standing post (2); two sides of the said generator (3) are conducted to the electric source through a conducting tab and a conducting cord (30); the outside of the said generator (3) is covered by a lay of heat conducting and insulating film (33) and is inserted into the interior of the standing post (2) through a C-shaped press element (31); after the insertion, the said generator (3) presses in an uni-direction towards the internal surface of the standing post (2) to relatively achieve a pressing heat conduction effect; with a sufficient surface range inside the cup body (1), a plurality of the said standing posts (2) can be disposed to form a plurality of heat resources.

Figure 2:
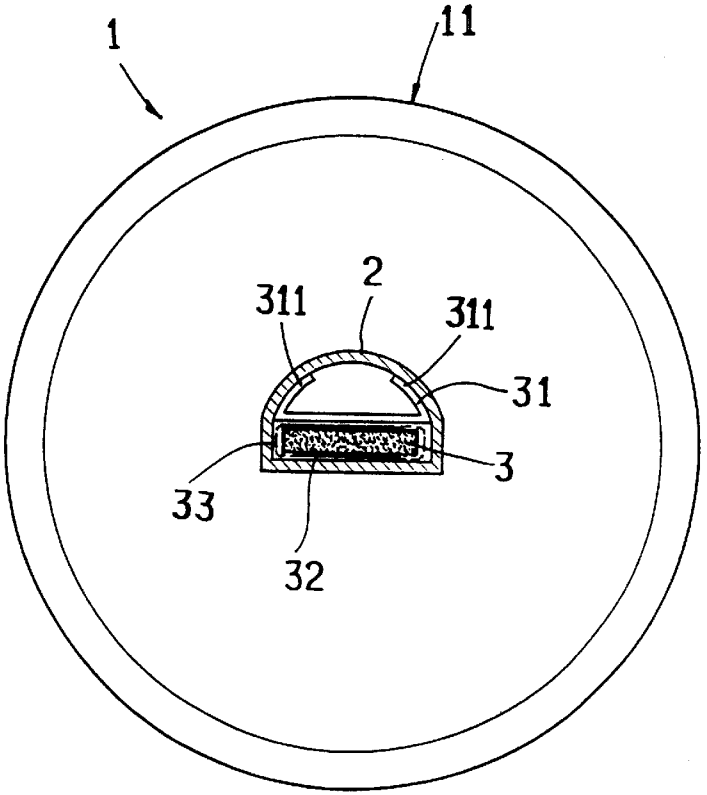
FIG. 2 is a bird's-eye view and cross-sectional drawing of the assembled present invention.

Referring to FIG. 2, the external surface of the said generator (3) is covered by a lay of heat conducting and insulating film (33); the resilient function of the upward side wings (311) of the press element (31) squeeze and press toward the back side of the said generator (3) to affix it with a pressing force oppositely to the flat internal surface of the said standing post (2) and to transmit the heat generated therefrom more completely.

Figure 3:
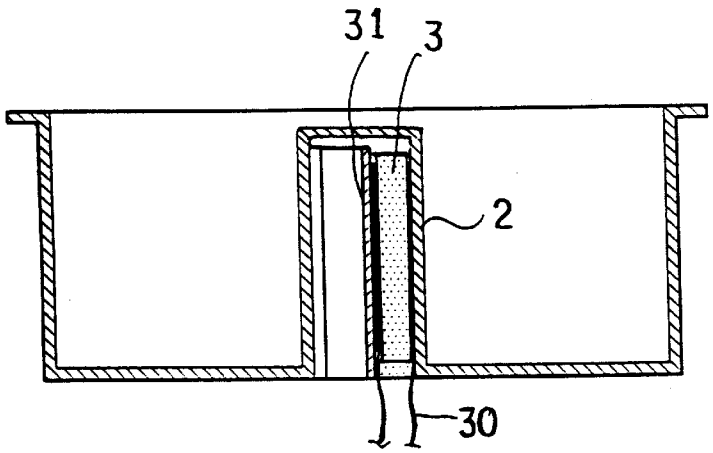
FIG. 3 is a cross-sectional drawing of the testing relationship of the assembled present invention.

Referring to FIG. 3, the said generator (30) is housed inside the said standing post (2), pressed by the press element (31) and conducted to the electricity through the conducting cord (30); the top end opening of the said standing post (2) is sealed; as to the entire cup body (1), the said generator (3) can achieve a completely waterproof effect and internally heat the water liquid inside; during the heating procedure, as long as any height of the upper surface film of the water liquid touches the circumferential bordering line defined by any height position on the outer circular surface of the standing post (2), the portion adjacent to the upper surface bordering area of the said standing post (2) will partially form film-line shape to be vaporized rapidly due to the direct heating from the said generator (3); therefore, to view it vertically, the water liquid of the water surface at any water position adjacent to the area bordered with the said standing post (2), is rapidly effected by the said generator (3) to generate steam right away and that tremendously shortens the waiting time for steam generation; of course, the predetermined high/low heat effect of the generator (3) can achieve the desirable amount of vaporization.

The generator (3) is comprised by a ceramic-made electric resistance of a positive temperature coefficient, therefore it possesses heat conducting effect; when it is close to the heat source on one side of the press element (31), the air blocking effect of the space existing between the said press element (31) and the standing post (2) disables the high temperature on the opposite side of the said generator (3) to be rapidly conveyed outwards, only the temperature generated at the position of the flat plane (20) of the standing post (2) can be rapidly conveyed therefrom; since the said generator (3) possesses the heat transmitting effect, it conveys the related temperature on one side of the press element (31) toward the other end to form a transmitting effect of temperature supplement so that the said heat source can be conveyed toward one side of the flat plane (20) as much as possible.

Figure 4:
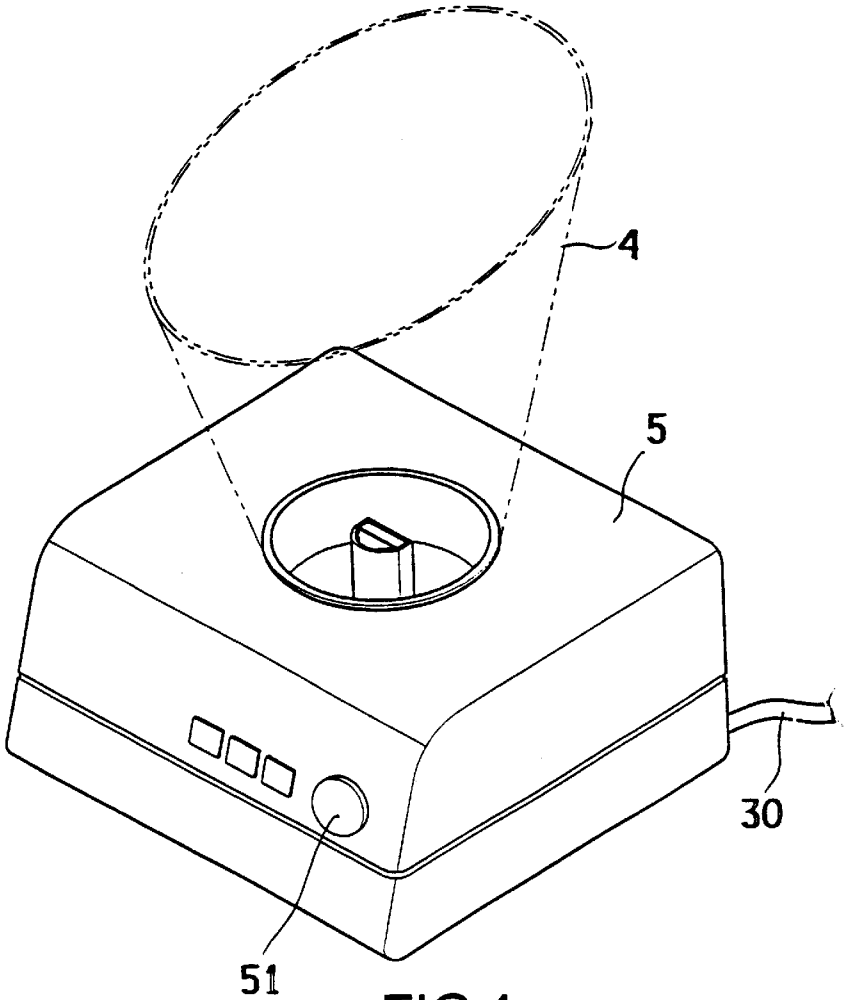
FIG. 4 is a drawing of an exemplary embodiment of the present invention.

Referring to FIG. 4, when the present vaporizer is applied to a facial steamer for cleansing the skin, mainly a guiding mask (4) is used to gather steam to dispense toward the face but not the two sides; no matter how much water is poured in, as long as a the water position, as shown in FIG. 3, reaches any height position inside the longitudinal height of the said standing post (2), the said generator (3), as shown in FIG. 3, can rapidly generate high temperature after being conducted to the electricity by the on/off switch (51) disposed on the machine body (5) and directly heat and vaporize the film-line bordering line formed on the topmost surface film of the liquid directly; therefore, once the on/off switch (51) is connected, the embodiment of the present invention can rapidly obtain steam generation; of course, after a certain period of heating time, the cupful liquid will be boiled due to the heat transmission of the liquid itself.

Figure 5:
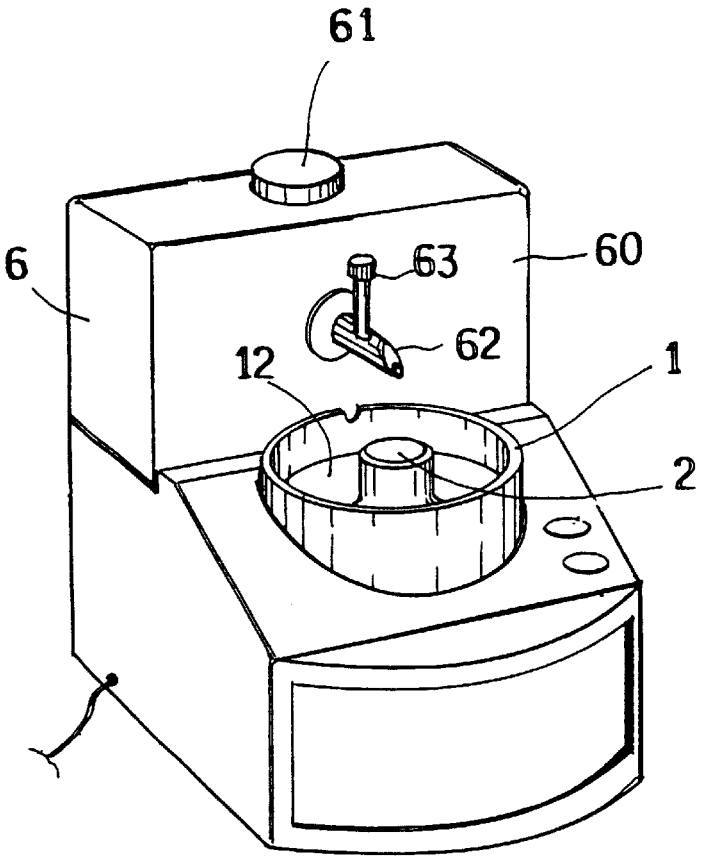
FIG. 5 is the first drawing of the exemplary embodiments of the present invention.

Referring to FIG. 5, the upward position of the surface range of the receiving container (12) disposed inside the cup body (1) can hold a dripping device (6); basically, the dripping device (6) is a water tank body (60) with a water inlet (61) disposed in the upper aspect; a tube opening (62) drains the water drop and a adjusting valve (63) adjusts the dripping speed; thereby, the dripping water is adjusted in speed to drip into the receiving container (12) or even to the upper surface of the standing post (2); the micro amount of water supplement in drops efficiently eliminates the prior temperature elevation time for more water liquid and rapidly evaporate the water drop at a micro second.

Figure 6:
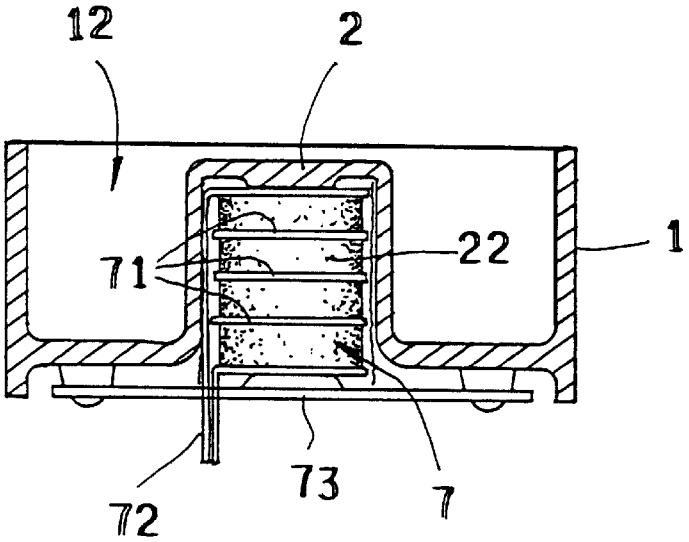
FIG. 6 is the second drawing of the exemplary embodiments of the present invention.

Referring to FIG. 6, the generator (3) disposed inside the said cup body (1) can be in the form of stacked generators (7); similarly positioned inside the standing post (2), a plurality of ceramic-made electric resistant tabs (71) of positive temperature coefficient are comprised in a stack; the bottom portion of the entirety is pressed, supported and positioned by a press plate (73) and conducted to electricity through a plurality of optional and individual electric source conducting cords (72); thereby more heat generating electric resistant tabs can be installed to obtain more power rate or optional applications at multiple power rates.

Figure 7:
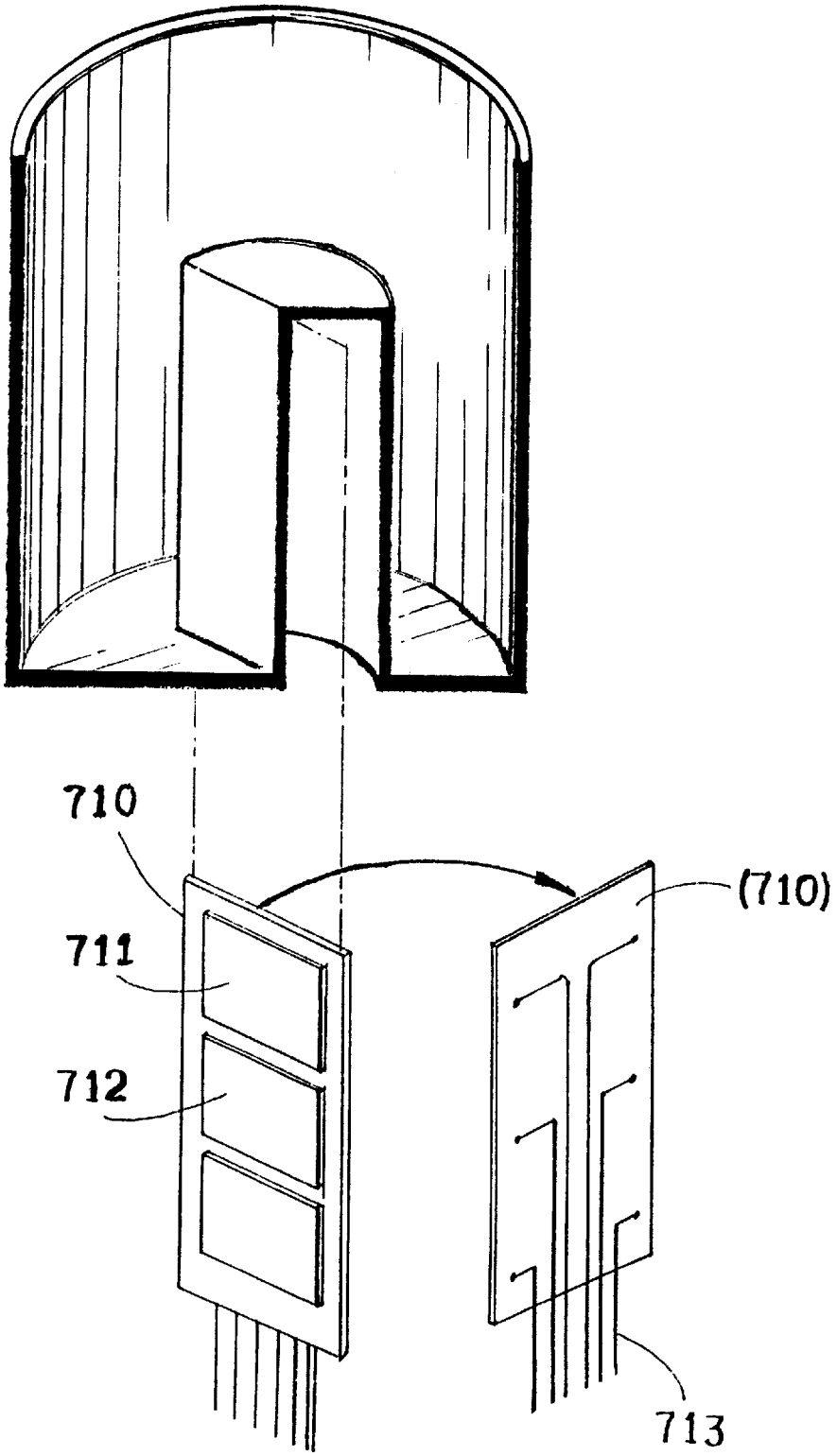
FIG. 7 is a drawing of another exemplary embodiment of the heat generator of the present invention.

Referring to FIG. 7, if the space inside the standing post (2) is sufficiently enough, not only the area of the ceramic-made electric resistant tabs can be enlarged, they can be cut into a plurality of electric resistant tabs (711, 712) supported by a bottom plate (710) to comprise multiple tabs on one plane; by different connections, a plurality of electric cords (713) can be conducted synchronously or individually to obtain optional applications at different power rates, relatively at different temperature or working efficacies to meet various application requirements.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A vertically working liquid vaporizer comprising:

a) a cup body including an encircling dam bounding a receiving container and a standing post disposed at a center thereof, the standing post having a D-shape cross-sectional configuration with a single flat side and a curved side;

b) a heat generator including at least one ceramic, electric-resistance heating element with a positive temperature coefficient mounted in the standing post; and, c) a press element located in the standing post, the press element in contact with the heat generator, and including resilient side wings in contact with an inner surface of the curved side of the standing post so as to urge the heat generator into contact with an inner surface of the flat side of the standing post.

2. The vertically working liquid vaporizer of claim 1 wherein the heat generator includes a plurality of ceramic, electric-resistance heating elements.

3. The vertically working liquid vaporizer of claim 1 further comprising a dripping device for dripping liquid into the cup body, the dripping device including:

a) a liquid holding tank having a liquid inlet;

b) a drain tube extending outwardly from the liquid holding tank; and, c) an adjusting valve in the drain tube for adjusting the liquid dripping from the drain tube.

* * * * *